US006908421B2

(12) United States Patent
Koborinai et al.

(10) Patent No.: US 6,908,421 B2
(45) Date of Patent: Jun. 21, 2005

(54) FILTER MANUFACTURING MACHINE

(75) Inventors: Masanori Koborinai, Tokyo (JP); Hiroyuki Torai, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 164 days.

(21) Appl. No.: 10/362,926

(22) PCT Filed: Aug. 29, 2001

(86) PCT No.: PCT/JP01/07427

§ 371 (c)(1),
(2), (4) Date: Feb. 27, 2003

(87) PCT Pub. No.: WO02/17738

PCT Pub. Date: Mar. 7, 2002

(65) Prior Publication Data

US 2003/0173418 A1 Sep. 18, 2003

(30) Foreign Application Priority Data

Aug. 31, 2000 (JP) ..... 2000-263710

(51) Int. Cl.[7] ..... B31C 13/00
(52) U.S. Cl. ..... 493/39; 493/42; 493/44
(58) Field of Search ..... 493/39, 42, 44, 493/45, 46, 48, 49, 50

(56) References Cited

U.S. PATENT DOCUMENTS 3,741,846 A * 6/1973 Greve ..... 156/360
3,744,108 A * 7/1973 Greve ..... 28/282
3,774,508 A * 11/1973 Berger et al. ..... 493/47
3,847,064 A * 11/1974 Berger ..... 493/44
RE28,487 E * 7/1975 Muller ..... 131/261 B
3,960,645 A * 6/1976 Brackmann et al. ..... 156/441
4,179,323 A * 12/1979 Sigmon ..... 156/201
4,281,671 A * 8/1981 Bynre et al. ..... 131/335
4,537,583 A * 8/1985 Pryor ..... 493/42
4,549,875 A * 10/1985 Pryor ..... 493/49
5,163,452 A * 11/1992 Marritt et al. ..... 131/84.1

FOREIGN PATENT DOCUMENTS

| | | |
|---|---|---|
| JP | 6-327455 A | 11/1994 |
| JP | 7-203935 A | 8/1995 |
| JP | 8-187073 A | 7/1996 |
| JP | 20000-83642 A | 3/2000 |
| JP | 2000-157247 A | 6/2000 |

* cited by examiner

*Primary Examiner*—Sameh H. Tawfik
(74) *Attorney, Agent, or Firm*—Birch, Stewart, Kolasch, & Birch, LLP

(57) ABSTRACT

A filter-manufacturing machine comprises spray nozzles located on both sides of a feeding path of sheet material made of filter fibers, respectively, and the spray nozzles each have a line of spray holes of a liquid binder with high viscosity and a plurality of air jetting openings for jetting compressed air. The liquid binder sprayed from the lines of the spray holes is subdivided into particles by the compressed air, thereby spraying the particles of the liquid binder evenly on both surfaces of the sheet material.

10 Claims, 4 Drawing Sheets

FILTER MANUFACTURING MACHINE

This application is the national phase under 35 U.S.C. § 371 of PCT International Application No. PCT/JP01/07427 which has an International filing date of Aug. 29, 2001, which designated the United States of America.

TECHNICAL FIELD

The present invention relates to a filter-manufacturing machine for manufacturing a filter rod to be used for filter plugs of filter cigarettes.

BACKGROUND ART

This kind of filter-manufacturing machine is disclosed in, for example, Japanese Patent Provisional Publication No. Hei 7-203935. This publicly-known manufacturing machine comprises a storage container storing tow formed of filter fibers, and the tow is fed from the storage container along a predetermined feeding path. In the tow feeding process, the tow is opened and spread to be formed into sheet material. Then, plasticizer such as triacetin or the like is added to the sheet material, and the sheet material is supplied toward a rod-forming device. The rod-forming device, while shaping the sheet material into a rod, wraps the rod-shaped sheet material in paper to consecutively form a filter rod.

Since the filter fibers of tow are bonded by plasticizer within the filter rod, the outer shape of the filter rod is stably maintained. Moreover, the hardness of a filter rod is determined by the amount of the added plasticizer, namely, bonding force between the filter fibers. Therefore, in the manufacture of filter rod of this kind, it is necessary to add plasticizer evenly on the whole surface of the sheet material. Conventionally, various methods, such as brush application method, roller transfer method, nozzle spray method, and the like, have been employed for adding the plasticizer. In the case that triacetin is used as plasticizer, the brush application method and the roller transfer method are widely used to add triacetin.

In the case where triacetin is used as plasticizer, triacetin liquefies the surfaces of the filter fibers and then is absorbed thereinto so as to form bond portions between the filter fibers, thus increasing the adhesive strength of the bond portions. Therefore, the filter rod in which triacetin is used as plasticizer, more specifically, the filter plug of a filter cigarette, the filter plug being obtained by cutting the filter rod, keeps low degradation thereof even if left in water.

On the other hand, in the case where a water-soluble material such as polyethylene glycol (PEG) is used as binder in place of triacetin, the filter plug has a high degradation. However, the PEG used as binder is in liquid form only in the state where it is heated as with hot melt adhesive, and the liquid PEG has still higher viscosity than triacetin.

A conventional nozzle used for spraying plasticizer has a low spray pressure, so that the nozzles is capable of spraying only a liquid plasticizer having relatively low viscosity, and incapable of spraying well a liquid material having high viscosity, such as liquid PEG and the like.

On the contrary, if the spray pressure of the nozzle may be increased, the nozzle can spray a certain amount of a liquid material with high viscosity. In this case, however, the liquid material can not be evenly added through the nozzle to the sheet material, making the hardness of the filter rod irregular. Additionally, the liquid material is scattered on machines in the vicinity of the nozzle in the filter-manufacturing machine, which makes it difficult to keep the stable operation of the filter-manufacturing machine.

DISCLOSURE OF THE INVENTION

An object of the present invention is to provide a filter-manufacturing machine capable of uniformly applying even a liquid material having high viscosity to sheet material and effectively preventing the liquid material from scattering around.

To achieve the above-mentioned object, a filter-manufacturing machine according to the present invention comprises a feeding device for consecutively feeding sheet material having filter fibers along a feeding path, a spray device for applying a liquid material to the sheet material on the feeding path, and a rod-forming device connected to a terminal end of the feeding path and wrapping the sheet material in paper while shaping the sheet material into a rod to consecutively form a filter rod. The spray device has a line of spray holes extending in a width direction of the sheet material and spraying the liquid material, and a plurality of air jet openings located in the vicinity of the line of the spray holes and jetting compressed air toward the liquid material sprayed from the spray holes so that particles of the liquid material subdivided by the compressed air are sprayed toward the sheet material in the form of mist or drops.

According to the above-described spray device for the filter-manufacturing machine, the particle spray area required on each spray hole is small, so that it is possible to keep low the spray pressure of the liquid material, even if the liquid material has high viscosity. As a result, the spray device can easily control the spray area of the particles sprayed through each spray hole, which enables not only the uniform application of the liquid material to the sheet material but also the prevention of the scatter of the liquid material.

More particularly, the liquid material is made of a liquid binder for bonding filter fibers of the sheet material, and the liquid binder liquid may contain polyethylene glycol. Polyethylene glycol not only excels in strength of bonding filter fibers but also has no bad influence on taste and flavor of a cigarette, thereby making it possible to obtain a filter rod appropriate for a cigarette.

Furthermore, the liquid binder may be a mixture of polyethylene glycol and desired flavorings.

Specifically, the spray device may comprises a spray nozzle having spray holes and air jet openings, a supply source for supplying a liquid binder, the supply source having a pump for pressurizing the liquid binder to supply the pressurized liquid binder toward the spray holes, a compressed air source for supplying compressed air toward the air jet openings, the compressed air source having a heater for heating the compressed air, and covering means for covering from the outside a spread area of particles sprayed through the spray nozzle.

Since the above-mentioned spray device comprises the pump for pressurizing and supplying the liquid binder, the device is capable of surely supplying the liquid binder to the spray holes even if the liquid binder has high viscosity. Also, since the compressed air ejected from the air jet openings has been heated, the compressed air prevents a decrease in temperature of the liquid binder in the spray nozzle, that is, an increase in viscosity of the liquid binder, thereby improving the atomization of the liquid binder. As a result, the spray device can apply the liquid binder to the sheet material more evenly. Moreover, the covering means surely prevents the scatter of the liquid binder.

The feeding device may include a storage container for storing tow of filter fibers, delivering means for delivering the tow from the storage container along the feeding path, and opening means for opening the tow in a horizontal direction to form the tow into sheet material in a tow-delivering process. In this case, the filter-manufacturing machine produces a filter rod of a general type.

On the other hand, the feeding device is not limited to the one forming sheet material from the tow of filter fibers. For instance, the feeding device may include a web roll in which a web of paper or non-woven fabric of filter fibers is wound, delivering means for delivering the web from the web roll along the feeding path, and crimping means for making vertical wrinkles in the web to form the web into crape sheet material in the web-delivering process. In this case, the spray device applies the liquid binder on the crape sheet material.

Furthermore, the above-mentioned spray device may include spray nozzles located on both sides of the feeding path, respectively, the spray nozzles spraying particles of the liquid binder on both surfaces of the sheet material on the feeding path. In this case, since the liquid binder is applied to the both surfaces of the sheet material, each spray nozzle can apply the liquid binder to the sheet material evenly.

In the case that two spray nozzles are provided as described above, it is desired that the spray nozzles are located adjacently with each other above and below. In this case, conditions of application of the liquid binder through each spray nozzle to the sheet material become the same.

The spray nozzle forms a spray area of particles penetrating the sheet material, namely, a spread area of the particles, which has a head portion on the spray nozzle side and a tale portion on an opposite side of the spray nozzle side with respect to the sheet material. In this case, the covering means may include a front cover for covering the head portion of the spread area from the outside, a back cover for confining the tale portion thereof from the outside, and suppressing means for suppressing turbulence of the tale portion in the spread area within the back cover.

The front and back covers surely prevent the scatter of the liquid binder, whereas the suppressing means stabilizes the head portion of the spread area on the spray nozzle side, making more even the application of the liquid binder to the sheet material.

BEST MODE OF CARRYING OUT THE INVENTION

Figure 1:
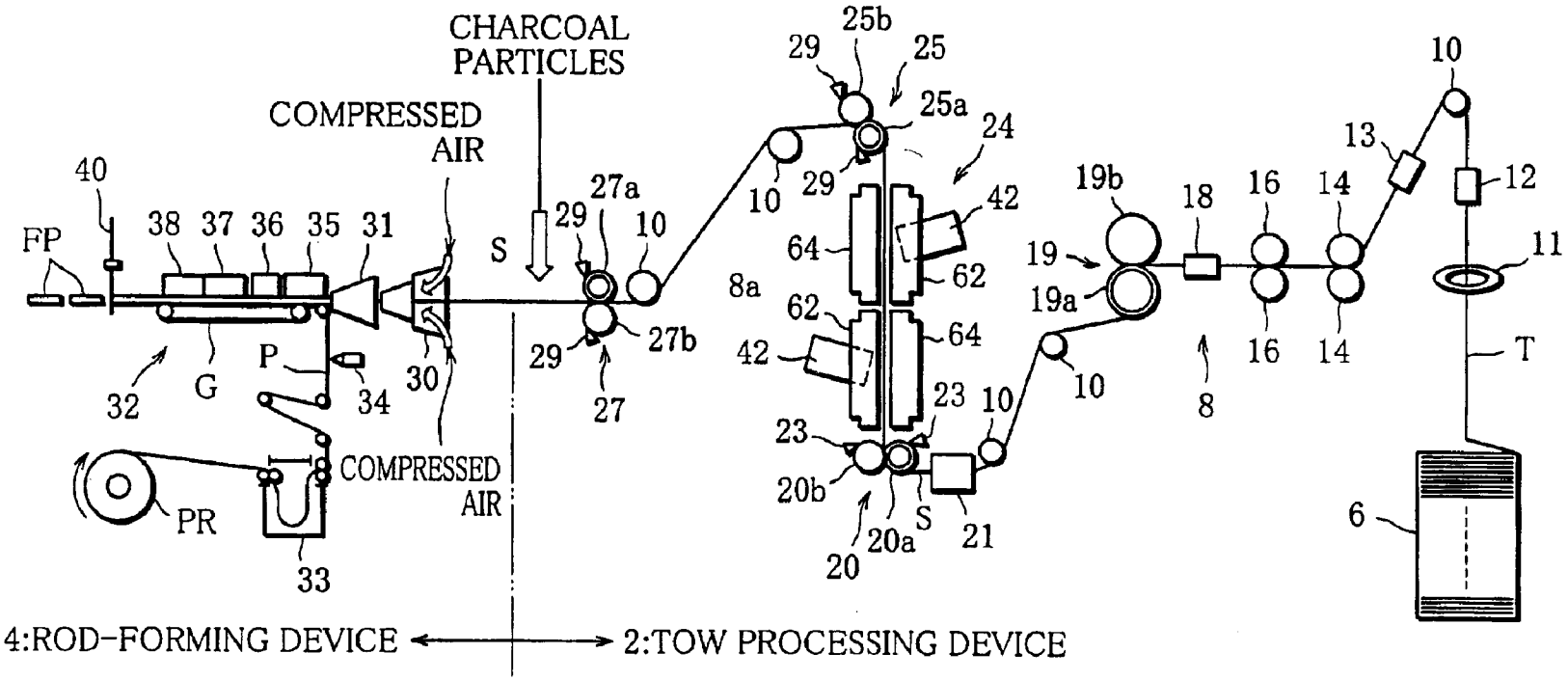
FIG. 1 is a schematic view showing a filter-manufacturing machine according to an embodiment of the present invention.

A filter-manufacturing machine shown in FIG. 1 generally comprises a tow processing device 2 and a rod-forming device 4. The tow processing device 2 includes a storage container 6 for filter material, and the filter material or tow T formed from filter fibers such as cellulose acetate fibers or the like is stored in the storage container 6. The tow T can be consecutively drawn out from the storage container 6 along a feeding path 8.

More concretely, the feeding path 8 is defined by a plurality of guide rollers 10 and connected to the rod-forming device 4. A ring guide 11, a first banding jet 12, a second banding jet 13, a pair of pretension rollers 14, a pair of blooming rollers 16 and a third banding jet 18 are interposed in the feeding path 8 in order from the storage container 6 side.

Moreover, a feed roller unit 19 and a first nip roller unit 20 are located in order downstream of the third banding jet 18 in the feeding path 8, and a fourth banding jet 21 is disposed between the units 19 and 20. The feed roller unit 19 has a feed roller 19*a* and a backup roller 19*b* located with the feeding path 8 interposed therebetween, the rollers 19*a* and 19*b* being steel rollers. The first nip roller unit 20 also has a driving roller 20*a* and a pinch roller 20*b* located with the feeding path 8 interposed therebetween, the rollers 20*a* and 20*b* being provided with scrapers 23, respectively. The scrapers 23 are intermittently brought into contact with peripheral surfaces of the corresponding rollers, thus decreasing abrasion of the scrapers 23.

When the feed roller unit 19 and the first nip roller unit 20 are activated, the tow T is drawn out from the storage container 6 along the feeding path 8. After passing the ring guide 11, the tow T is sequentially fed to the first and second banding jets 12 and 13. The first and second banding jets 12 and 13 open and spread the tow T in a horizontal direction. Thereafter, the tow T is further opened to be spread over to reach a desired width when passing the third banding jet 18 and the fourth banding jet 21 through the pretension rollers 14 and the blooming rollers 16. Accordingly, the tow T which has passed the fourth banding jet 21 is formed into sheet material S having a predetermined width. The scrapers 23 of the first nip roller unit 20 remove waste of the tow T which are attached to outer peripheral surfaces of the rollers 20*a* and 20*b*.

The above-mentioned first, second, third and fourth banding jets 12, 13, 18 and 21 blow out air toward the tow T to moderately smooth crimps of the tow T by adjusting a blowout amount and blowout pressure of the air. The pretension rollers 14 include a steel roller and a rubber roller sandwiching the feeding path 8 therebetween from above and below, and these rollers rotate while clamping the tow T to provide a predetermined tension to the tow T. The blooming rollers 16 also include a rubber roller and a steel roller with peripheral grooves, sandwiching the feeding path 8 therebetween from above and below, and these rollers further smooth the crimps of the tow T in cooperation with the pretension roller 14. Moreover, when the tow T passes the blooming rollers 16, the blooming roller, namely, the steel roller with the peripheral grooves provides difference to the tension of adjacent parts of the tow T in a width direction thereof. As a consequence, the tow T is divided into a plurality of bundles separating from each other in the width direction thereof, thus improving an opening effect of the tow T by means of the third and fourth banding jets 18 and 21.

In the feeding path 8, second and third nip roller units 25 and 27 are located in order downstream of the first nip roller unit 20. The units 25 and 27 each have a driving roller and a pinch roller provided with the respective scrapers 29 brought into contact with each other intermittently.

As is obvious from FIG. 1, the second nip roller unit 25 is located above the first nip roller unit 20, and thus a portion 8*a* of the feeding path 8 between the units 20 and 25 extends vertically. Disposed in the vertical portion 8*a* of the feeding path 8 is a spray device 24 for applying a liquid binder to the both surfaces of the sheet material S which has passed the first nip roller unit 20. Accordingly, the second and third nip roller units 25 and 27 feed the sheet material S provided with the liquid binder toward the rod-forming device 4, and the scrapers 29 of the units 25 and 27 remove the waste of the tow T and the liquid binder attached to outer peripheral surfaces of the corresponding rollers.

The rollers of the first, second and third nip roller units 20, 25 and 27, and the guide roller 10 located between the units 25 and 27 each have a built-in heater (not shown), and the rollers are heated by the respective heaters to a predetermined temperature. Thus, when the sheet material S passes the rollers of the second and third nip roller units 25 and 27 and the guide roller 10, the sheet material S is prevented from twining around the rollers.

A terminal end of the feeding path 8 is connected to a stuffer jet 30 of the rod-forming device 4, and a wrapping section 32 is located downstream of the stuffer jet 30 via a trumpet guide 31.

By being supplied with compressed air, the stuffer jet 30 forcibly pushes the sheet material S fed from the third nip roller unit 27 into the trumpet guide 31. Thus, the sheet material S is prevented from twining around the third nip roller unit 27, which secures the stable pushing of the sheet material S into the trumpet guide 31.

The rod-forming device 4 is provided with a regulator (not shown), for regulating temperature of the compressed air to be supplied to the stuffer jet 30. If the temperature of the compressed air is maintained relatively low so as to be less than room temperature, hardening of the liquid binder applied to the sheet material S is improved. On the contrary, if the temperature of the compressed air is kept high, the hardening of the liquid binder is restrained.

The trumpet guide 31 concentrates the sheet material S stuffed by the stuffer jet 30 so that the sheet material S is shaped into a rod and sends the resultant rod to the wrapping section 32. Thereafter, the rod-shaped sheet material S is fed to the wrapping section 32. When passing the wrapping section 32, the rod-shaped sheet material S is wrapped in paper P while being subjected to compression molding to be formed into a filter rod FR. The filter rod FR is consecutively sent out from the wrapping section 32.

The wrapping section 32 has a structure basically similar to that of the wrapping section of a cigarette-manufacturing machine. In other words, the paper P is supplied from a paper roll PR to the wrapping section 32 via a reservoir 33, and in this process, paste is applied from a spray gun 34 to one side edge of the paper P.

On the other hand, the wrapping section 32 is provided with an endless garniture tape G, and the garniture tape G is supplied with the paper P and the rod-shaped sheet material S to make the paper P and the rod-shaped material S travel in one direction through a tongue 35 of the wrapping section 32. When the rod-shaped sheet material S passes the tongue 35 together with the paper P, the tongue 35 compresses the rod-shaped sheet material S, whereas the wrapping paper P is formed to be U-shaped to wrap the rod-shaped sheet material S from downside.

The tongue 35 and the trumpet guide 31 each have a built-in heater (not shown), and these heaters heat the tongue 35 and the trumpet guide 31 to a predetermined temperature. If the trumpet guide 31 and the tongue 35 are maintained at a high temperature in this way, the hardening and a stain of the liquid binder applied to the sheet material S on the trumpet guide 31 and tongue 35 are decreased. Thus, frictional resistance between the sheet material S and the trumpet guide 31, and that between the sheet material S and the tongue 35, are not increased.

Then, the paper P and the rod-shaped sheet material S pass a forming holder 36, and in this process, the rod-shaped sheet material S is completely wrapped in the paper P, thereby forming the filter rod FR. The filter rod FR further passes a heater 37 and a cooler 38 in order. The heater 37 dries the pasted part of the paper P by heating, and simultaneously melts the applied binder to make the liquid binder penetrate into the sheet material S. Thereafter, the filter rod FR is made cool by the cooler 38. When the filter rod FR passes a cutting knife 40, the cutting knife 40 cuts the filter rod FR, and thus filter plugs FP of a predetermined length can be obtained.

Figure 2:
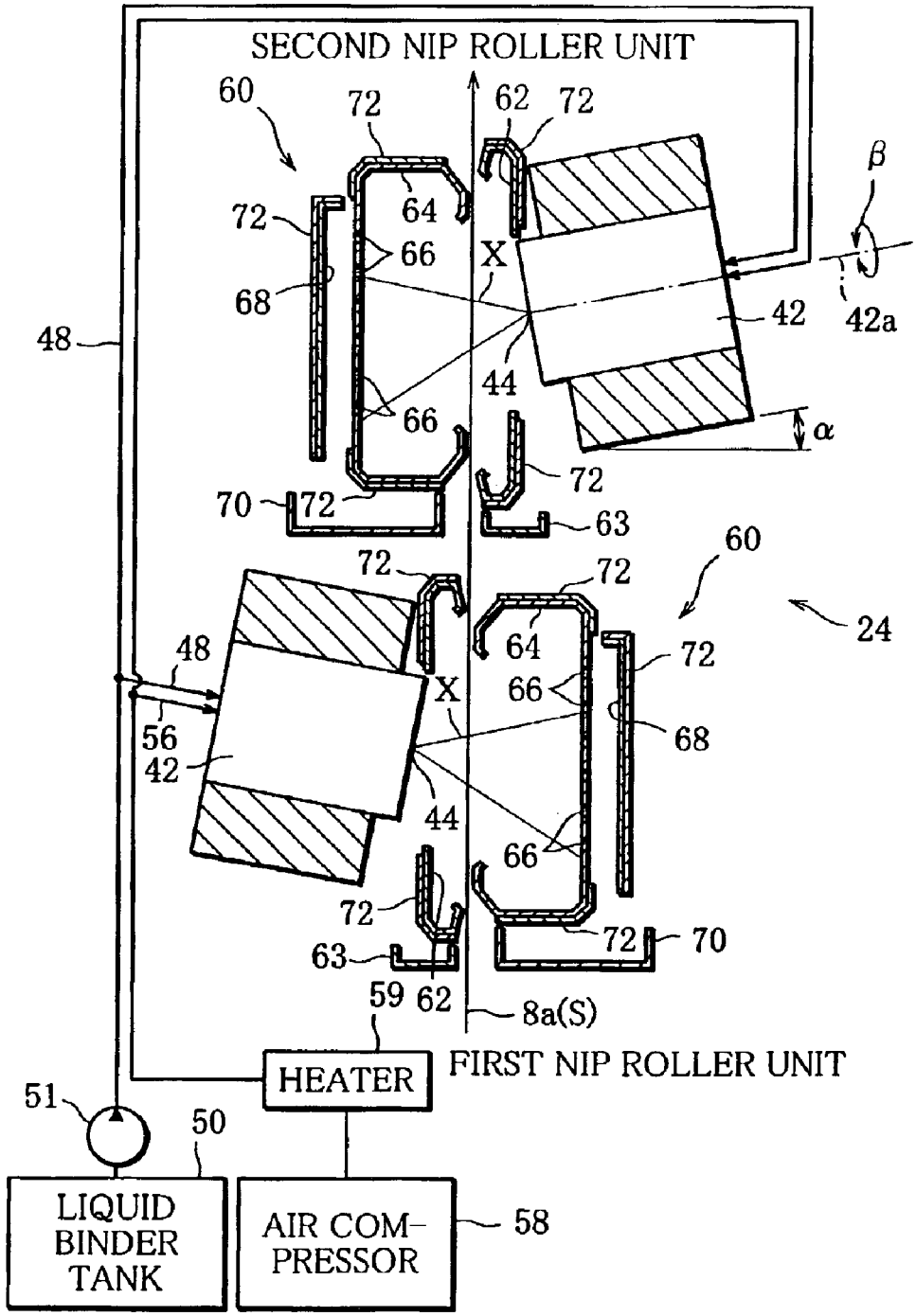
FIG. 2 is a view showing a detail of a pair of spray nozzles in FIG. 1 and vicinity thereof.

Referring to FIG. 2, the aforementioned spray device 24 is illustrated more in detail.

The spray device 24 is provided with a pair of spray nozzles 42 located adjacently to the vertical portion 8*a* of the feeding path 8 in a vertical direction, and with the vertical portion 8*a* interposed therebetween.

Each spray nozzle 42 is tiltable with respect to a horizontal plane and also rotatable about an axis 42*a* thereof. Therefore, as shown in FIG. 2, a tilt angle $\alpha$ of each spray nozzle 42 with respect to the horizontal plane and a rotational angle $\beta$ of each spray nozzle 42 with respect to the travelling direction of the sheet material S can be voluntarily adjusted. In the case of this embodiment, each spray nozzle 42 is disposed slightly at a downward slant. Moreover, distance between each spray nozzle 42 and the vertical portion 8*a* of the feeding path 8 can be also adjusted.

Figure 3:
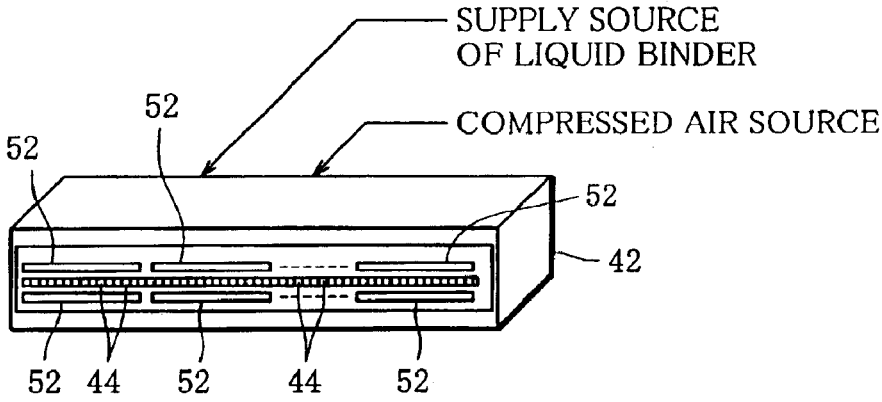
FIG. 3 is a perspective view of the spray nozzle.
Figure 4:
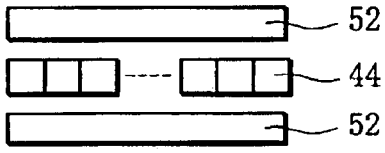
FIG. 4 is an enlarged view of a part of the spray nozzle in FIG. 3.

As shown in FIGS. 3 and 4, the spray nozzle 42 has a line of spray holes 44, the line extending in the width direction of the sheet material S on the feeding path 8. The spray holes 44 open toward the sheet material S and are located adjacently to one another.

A plurality of air jetting slits 52 opens above and below the line of the spray holes 44. The air jetting slits 52 extend parallel to the line of the spray holes 44, and a predetermined space is secured between the horizontally adjacent air jetting slits 52.

Figure 5:
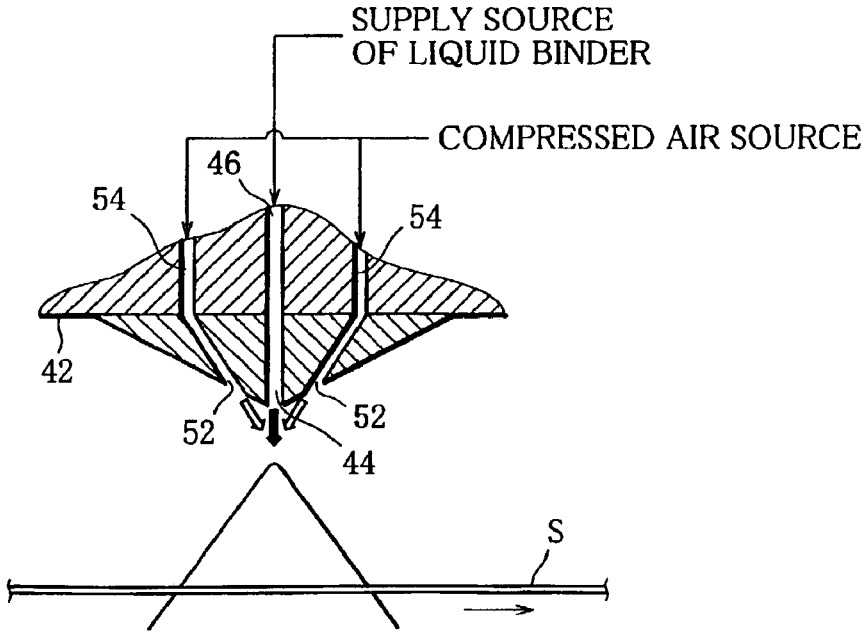
FIG. 5 is a cross-sectional view showing the vicinity of a spray hole of the spray nozzle.

FIG. 5 illustrates a cross-sectional view of one of the spray holes 44 and vicinity thereof. The spray hole 44 is communicated with an internal passage 46 of the spray nozzle 42, the internal passage 46 being connected to a supply source of the liquid binder via an external tube 48 covered with a heater (not shown).

Specifically, the supply source of the liquid binder includes a tank 50 and a gear pump 51 as shown in FIG. 2. The liquid binder is stored in the tank 50, and in the case that the liquid binder remains in liquid form only in a heated state as with hot melt adhesive, the tank 50 is provided with a heater (not shown) for heating the liquid binder.

In the case of the embodiment, polyethylene glycol (PEG) is used as a liquid binder. The PEG not only excels in a bonding force of filter fibers but also has a function of improving the degradation of the filter plug when being put into water. The PEG is known in various forms such as liquid and hard wax. The PEG used in this embodiment is solid at room temperature, but is used as the liquid binder after being heated and melted to a coagulating point or more. Although the liquid binder liquid made of such PEG has a wide-ranging viscosity of several tens to 30,000 mPa·s, the higher the viscosity of the liquid binder is, the better binding performance (high bonding force of filter fibers) the liquid binder exerts.

Moreover, the liquid binder is not limited to PEG. Not only polyalkylene oxide resin and polyvinylalcohol resin other than PEG, a water-soluble polymer, and a thermoplastic polymer, but also other publicly-known adhesive agents may be used as liquid binders. Additionally, the liquid binder may contain desired flavorings.

The gear pump 51 delivers the liquid binder in the tank 50. The liquid binder delivered from the gear pump 51 is supplied through the tube 48 to each spray nozzle 42. Accordingly, the pressurized liquid binder, which has been supplied to each spray nozzle 42, is sprayed from desired spray holes 44 on the both surfaces of the sheet material S on the feeding path 8. Moreover, the spraying of the liquid binder from each spray hole 44 is controlled by opening and closing an electromagnetic valves (not shown) interposed in the internal passage 46.

On the other hand, as shown in FIG. 5, each air jetting slit 52 is communicated with a compressed air source through air passages 54 provided in the spray nozzle 42 and an external air pipe line 56 shown in FIG. 2.

As shown in FIG. 2, the compressed air source comprises an air compressor 58 and a heater 59 for heating the compressed air supplied from the air compressor 58. The compressed air source supplies the heated compressed air to each air jetting slit 52, and the compressed air is blown out from each air jetting slit 52 toward the sheet material S. Such blowout of the compressed air produces so-called atomized air and subdivides into particles, that is, atomizes the liquid binder sprayed from the spray holes 44. As a result, the spray nozzle 42 uniformly sprays the atomized liquid binder on the both surfaces of the sheet material S. Moreover, the spraying of the heated compressed air from the air jetting slit 52 can be also controlled by using electromagnetic valves (not shown) inserted in the air passages 54 formed in the spray nozzle 42.

Figure 6:
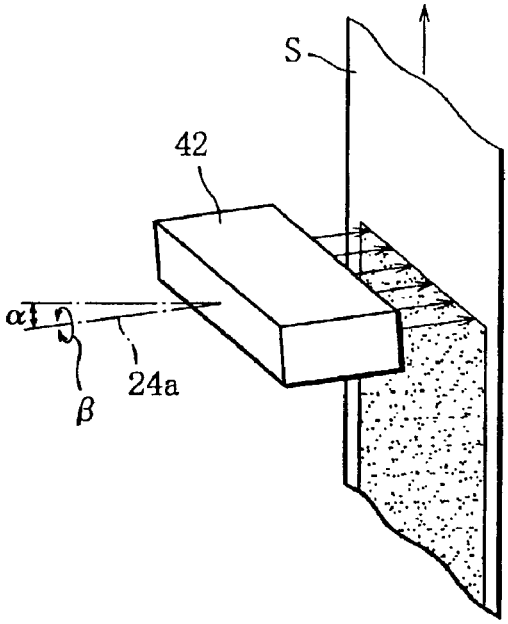
FIG. 6 is a perspective view showing a state where liquid a binder is applied to sheet material by the spray nozzle.

If the atomized liquid binder is sprayed on the sheet material S from the spray holes 44 of which the number is selected depending on the width of the sheet material S, the liquid binder is evenly applied to the both surfaces of the sheet material S as shown in FIG. 6. Consequently, the filter rod FR including the sheet material S has stable hardness.

Since the spray holes 44 are provided in number depending on the width of the sheet material S, even if the liquid binder has high viscosity, it is possible to keep low the spray pressure required for the spraying of the liquid binder. Because the spray pressure of the liquid binder is low, the spray area of the atomized liquid binder from each spray hole 44 is clearly defined, and the atomized liquid binder can be evenly and efficiently applied to the predetermined surface area of the sheet material S. Furthermore, each spray nozzle 42 is slightly slanted downward as mentioned above, which also contributes to the efficient application of the atomized liquid binder to the sheet material S.

Moreover, since each spray nozzle 42 sprays the atomized liquid binder in a substantially horizontal direction toward the sheet material S fed in the vertical direction, applying conditions of the liquid binder with respect to the both surfaces of the sheet material S are equal. Thus, unevenness in the amount of the applied liquid binder between the both surfaces of the sheet material S does not occur. In this respect, if the atomized liquid binder is sprayed on the horizontally fed sheet material S from above and below, it is necessary to consider a difference of the spraying force of the liquid binder, which is caused to gravitational influence.

Additionally, the spray nozzle 42 may subdivide the liquid binder into droplets so as to spray the droplet of binder on the sheet material S instead of the atomized liquid binder. In this case, too, the droplet binder can be evenly applied to the sheet material S.

Referring to FIG. 2 again, a cover device 60 is associated with each spray nozzle 42. The cover device 60 will be described below.

The cover device 60 comprises a front cover 62 located between the corresponding spray nozzle 42 and the feeding path 8. The front cover 62 is shaped into a rectangular box and extends in a width direction of the spray nozzle 42. The front cover 62 has both sidewalls facing the spray nozzle 42 and the feeding path 8, respectively, the both sidewalls being provided with the respective apertures. One of the apertures faces the spray nozzle 42, whereas the other widely opens toward the feeding path 8. An outlet (not shown) is formed on a bottom wall of the front cover 62, and a tray 63 is disposed under the outlet. In addition, an inspection door (not shown) is provided on one of end walls of the front cover 62, and can be opened and closed.

On the other hand, a back cover 64 is located on the opposite side of the feeding path 8 so as to be opposed to the front cover 62. The back cover 64 also has both sidewalls. One of the sidewalls on the feeding path 8 side widely opens, while the other is provided with a plurality of vents 66 distributed thereon. Moreover, an inspection door (not shown) is also provided on one of end walls of the back cover 64, and can be opened and closed.

Disposed at the rear of the back cover 64 is a screen plate 68. The screen plate 68 faces the distribution area of the vents 66, and an upper end of the screen plate 68 is bent toward the back cover 64. A bottom wall of the back cover 64 is also provided with an outlet (not shown) and a tray 70 is located under the outlet and the screen plate 68.

Furthermore, rubber heaters 72 are each mounted on an external surface of the front cover 62, an external surface of the back cover 64 except for the distribution area of the vents, and a back surface of the screen plate 68. The rubber heaters 72 heat the front cover 62, the back cover 64 and the screen plate 68 to a predetermined temperature, respectively.

As illustrated in FIG. 2, the atomized liquid binder sprayed from the spray nozzle 42 has a dispersion area penetrating the sheet material S, that is, a spread area X including a head portion on the spray nozzle 42 side and a tale portion on an opposite side of the spray nozzle 42 side.

The front cover 62 covers the head portion of the spread area X of the atomized liquid binder from the outside, whereas the back cover 64 confines the tale portion of the spread area X from the outside. Therefore, the front cover 62 and the back cover 64 surely prevent the scatter of the atomized liquid binder. As a result, the liquid binder liquid does not stain machine parts in the vicinity of the spray device 24.

Since the vents 66 are distributed on the other sidewall of the back cover 64, an air flow caused due to the spraying of the atomized liquid binder can escape through the vents 66. Therefore, a turbulent air flow is not produced within the back cover 64, so that the tale portion of the spread area X is not disturbed by the turbulent flow. Consequently, the spread area X of the atomized liquid binder penetrates the sheet material S in a stable state, which secures the even application of the liquid binder to the sheet material S.

On the other hand, although the vents 66 allow the atomized liquid binder to pass therethrough partially, the atomized liquid binder which has passed through the vents 66 is received by the screen plate 68, which prevents the scatter of the passed atomized liquid binder.

The liquid binder received by the screen plate 68 flows down on the screen plate 68 to be collected in the tray 70. The liquid binder captured by internal walls of the front cover 62 and back cover 64 is also collected through the outlets of the covers 62 and 64 into the trays 63 and 70, respectively. As mentioned above, the front cover 62, the back cover 64 and the screen plate 68 have already been heated by the respective rubber heaters 72 at this moment, so that the liquid binder does not coagulate in the front cover 62 and back cover 64 and on the screen plate 68. Thus, the liquid binder can be surely collected in the trays 63 and 70.

The present invention is not limited to the above embodiment and may be modified in various ways. For instance, the spray nozzles 42 are located on the vertical portion 8*a* of the feeding path 8, but may be so located as to sandwich a horizontal portion of the feeding path 8 therebetween from above and below. Also, the spray device 24 may be provided with one spray nozzle 42.

Although the nozzle device 42 according to the present invention is suitable for the spraying of liquid materials with high viscosity, such as PEG, the nozzle device 42 is also capable of spraying other liquid materials with low viscosity.

The filter-manufacturing machine according to the present invention is not limited to the manufacture of the plane filter rod and may be applied to the manufacture of a charcoal filter rod. In this case, a spraying device of charcoal particles is disposed on the terminal end of the feeding path 8. The spraying device distributes charcoal particles on an upper surface of the sheet material S in a position right before the stuffer jet 30 as shown in FIG. 1. In case that the spraying device of charcoal particles is provided, it is desired that the stuffer jet 30 is provided at an outlet thereof with a guide (not shown) for suppressing the scatter of charcoal particles.

The sheet material S is not limited to the tow made of cellulose acetate fibers and may include another material or a mixture of both. More particularly, for another material, it is possible to use a publicly-known material, such as natural or semisynthetic material. (for example, pulp, linters, cotton, hemp, viscose rayon, cuprammonium rayon, wool, or the like, or microbial production system biodegradable polymer such as polyhydroxyalkanoate or the like), general synthetic material (for example, polyolefin such as polypropylene, polyester such as polyethylene terephthalate, and polyamide), biodegradable synthetic material (for example, polylactic acid, polycaprolactone, polybutylene succinate, and polyvinyl alcohol), photodegradable material, or the like. These other materials can be produced in the form of tow, non-woven fabric, paper, or the like, individually or by mixing two or more materials.

Figure 7:
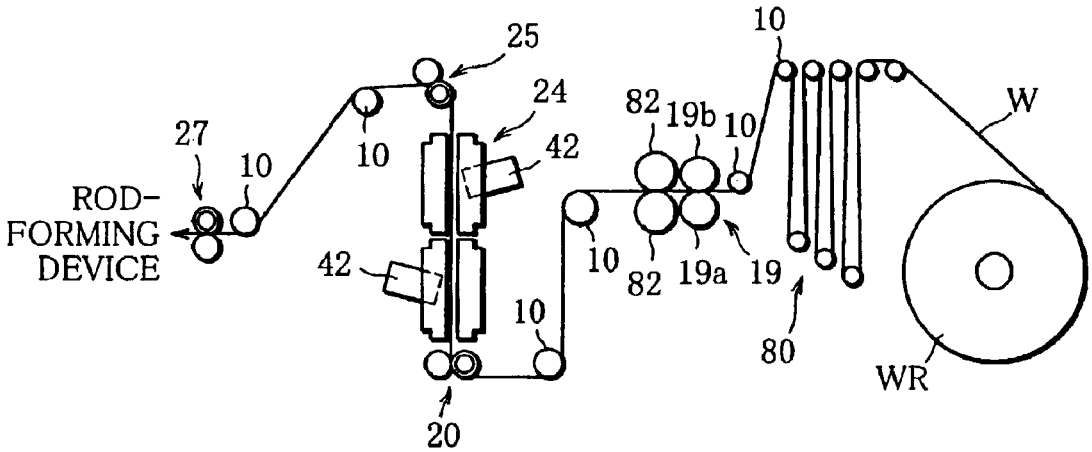
FIG. 7 is a schematic view showing an example of modification of the filter-manufacturing machine.

FIG. 7 illustrates an example of a supplying device for supplying webs made of paper or non-woven fabric as sheet material S. The supplying device comprises a web roll WR and is capable of drawing out a web W from the web roll WR along the feeding path 8. A feed roller unit 19 is disposed in the feeding path 8, and a dancer roller 80 is located between the feed roller unit 19 and the web roll WR. A pair of crepe rollers 82 are rotatably disposed right downstream of the feed roller unit 19 with the feeding path 8 interposed therebetween. The crepe rollers 82 are comb tooth rollers engaged with each other with a gap interposed therebetween. When the web W passes, the crepe rollers 82 crimp the web W in the longitudinal direction thereof, thereby forming the web W into a crepe sheet material S. Thereafter, at the time of passing the aforementioned nozzle device 24, the atomized liquid binder is applied to the crepe sheet material S. Then, the sheet material S is supplied toward the rod-forming device 4.

What is claimed is:

1. A filter-manufacturing machine comprising:

a feeding device for consecutively feeding sheet material including filter fibers along a feeding path, a spray device for applying a liquid material to the sheet material on the feeding path, said spray device including a line of spray holes extending in a width direction of the sheet material and spraying the liquid material, and a plurality of air jetting openings located in lines above and below the line of the spray holes, each of the air jetting openings above and below the spray holes jetting compressed air toward the liquid material sprayed from the spray holes, thereby spraying particles of the liquid material subdivided by the compressed air toward the sheet material, and a rod-forming device connected to a terminal end of the feeding path and wrapping the sheet material in paper while shaping the sheet material into a rod to consecutively form a filter rod.

2. The filter-manufacturing machine according to claim 1, wherein the liquid material is a liquid binder for bonding the filter fibers of the sheet material.

3. The filter-manufacturing machine according to claim 2, wherein said spray device includes:

a spray nozzle provided with the spray holes and the air jetting openings, a supply source of the liquid binder having a pump for pressurizing the liquid binder and supplying the pressurized liquid binder to the spray holes, a compressed air source for supplying compressed air toward the air jetting openings, the compressed air source having a heater for heating the compressed air, and covering means for covering from the outside a spread area of the particles sprayed from the spray nozzle.

4. The filter-manufacturing machine according to claim 3, wherein said feeding device includes:

a storage container storing tow made of filter fibers, delivering means for delivering the tow from the storage container along the feeding path, and opening means for opening the tow in a horizontal direction to form the tow into the sheet material in a tow-delivering process.

5. The filter-manufacturing machine according to claim 3, wherein said feeding device includes:

a web roll in which a web of paper or non-woven fabric made of filter fibers is wound, delivering means for delivering the web from the web roll along the feeding path, and crimping means for making vertical wrinkles in the web in a web-delivering process to form the web into a crepe sheet material.

6. The filter-manufacturing machine according to claim 3, wherein said spray device includes the spray nozzle located on each side of the feeding path, respectively, the spray nozzles spraying the particles of the liquid binder on both surfaces of the sheet material on the feeding path.

7. The filter-manufacturing machine according to claim 6, wherein the feeding path includes a portion extending vertically, and wherein the both spray nozzles are located adjacently in a vertical direction so that the vertical portion of the feeding path is interposed therebetween.

8. The filter-manufacturing machine according to claim 3, wherein the spray nozzle forms a spread area of the particles penetrating the sheet material, the spread area having a head portion on the spray nozzle side and a tale portion on an opposite side of the spray nozzle side, and wherein the covering means includes:

a front cover covering the head portion of the spread area from the outside, a back cover confining the tale portion of the spread area from the outside, and restricting means for restricting turbulence of the tale portion of the spread area within the back cover.

9. The filter-manufacturing machine according to claim 2, wherein the liquid binder includes polyethylene glycol.

10. A filter-manufacturing machine comprising:

a feeding device for consecutively feeding sheet material including filter fibers along a feeding path, a spray device for applying a liquid material to the sheet material on the feeding path, said spray device including a line of spray holes extending in a width direction of the sheet material and spraying the liquid material, and a plurality of air jetting openings located in the vicinity of the line of the spray holes, the air jetting openings jetting compressed air toward the liquid material sprayed from the spray holes, thereby spraying particles of the liquid material subdivided by the compressed air toward the sheet material, and a rod-forming device connected to a terminal end of the feeding path and wrapping the sheet material in paper while shaping the sheet material into a rod to consecutively form a filter rod, wherein the liquid material is a liquid binder for bonding the filter fibers of the sheet material, and wherein said spray device includes:

a spray nozzle provided with the spray holes and the air jetting openings, the spray holes located between the air jetting openings, a supply source of the liquid binder having a pump for pressurizing the liquid binder and supplying the pressurized liquid binder to the spray holes, a compressed air source for supplying compressed air toward the air jetting openings, the compressed air source having a heater for heating the compressed air, and covering means for covering from the outside a spread area of the particles sprayed from the spray nozzle.

* * * * *